US011691154B2

(12) United States Patent
Back

(10) Patent No.: US 11,691,154 B2
(45) Date of Patent: Jul. 4, 2023

(54) GRINDER, METHOD FOR OPERATION

(71) Applicant: Flender GmbH, Bocholt (DE)

(72) Inventor: Bruno Back, Issum (DE)

(73) Assignee: FLENDER GMBH, Bocholt (DE)

( * ) Notice: Subject to any disclaimer, the term of this patent is extended or adjusted under 35 U.S.C. 154(b) by 0 days.

(21) Appl. No.: 17/797,355

(22) PCT Filed: Jan. 19, 2021

(86) PCT No.: PCT/EP2021/051058
§ 371 (c)(1),
(2) Date: Aug. 3, 2022

(87) PCT Pub. No.: WO2021/164970
PCT Pub. Date: Aug. 26, 2021

(65) Prior Publication Data

US 2023/0057328 A1 Feb. 23, 2023

(30) Foreign Application Priority Data

Feb. 18, 2020 (DE) ..... 20158007.3

(51) Int. Cl.
*B02C 15/10* (2006.01)
*B02C 15/00* (2006.01)

(52) U.S. Cl.
CPC ..... *B02C 15/10* (2013.01); *B02C 15/006* (2013.01)

(58) Field of Classification Search
CPC ..... B02C 15/007; B02C 15/004; B02C 4/02; B02C 4/10; B02C 25/00
See application file for complete search history.

(56) References Cited

U.S. PATENT DOCUMENTS

| | | | | |
|---|---|---|---|---|
| 5,191,713 | A | 3/1993 | Alger et al. | |
| 7,182,283 | B1 | 2/2007 | Santucci | |
| 7,226,010 | B2 * | 6/2007 | Zhang | B02C 15/00 241/117 |
| 8,608,097 | B2 * | 12/2013 | Murphy | B02C 25/00 241/33 |
| 2016/0230842 | A1 | 8/2016 | Brun et al. | |
| 2018/0099288 | A1 | 4/2018 | Hoffmann et al. | |

FOREIGN PATENT DOCUMENTS

| | | |
|---|---|---|
| CN | 102421527 A | 4/2012 |
| CN | 108698049 A | 10/2018 |
| EP | 2 221 129 | 8/2010 |
| EP | 3 056 278 | 8/2016 |

OTHER PUBLICATIONS

International Search Report issued by the European Patent Office in international Application PCT/EP2021/051058 dated Jan. 19, 2021.

* cited by examiner

*Primary Examiner* — Matthew Katcoff
(74) *Attorney, Agent, or Firm* — Henry M. Feiereisen LLC

(57) ABSTRACT

A grinder includes a grinding table rotatable about a first rotational axis and at least two grinding rollers. Each of the at least two grinding rollers is arranged for rotation about a second rotational axis such that ground material can be comminuted between the grinding table and the grinding rollers during operation. A sensor arrangement can detect a change in inclination of the grinding table beyond a given threshold value.

14 Claims, 4 Drawing Sheets

GRINDER, METHOD FOR OPERATION

CROSS-REFERENCES TO RELATED APPLICATIONS

This application is the U.S. National Stage of International Application No. PCT/EP2021/051058, filed Jan. 19, 2021, which designated the United States and has been published as International Publication No. WO 2021/164970 A1 and which claims the priority of European Patent Application, Serial No. 20158007.3, filed Feb. 18, 2020, pursuant to 35 U.S.C. 119(a)-(d).

BACKGROUND OF THE INVENTION

The invention relates to a grinder having a grinding table which is rotatable about a first rotational axis and comprises at least two grinding rollers, each of which is arranged so as to rotate about a second rotational axis in each case, in such a manner that ground material can be comminuted between the grinding table and the grinding rollers during operation. In addition, the invention relates to a method for operating the grinder. In order to increase availability, it is proposed that the grinder comprises at least one sensor arrangement by means of which a change in inclination of the grinding table beyond a given threshold value can be detected.

A vertical mill having a grinding roller rolling on a grinding table, which comminutes ground material, is known from EP 3 056 278 A1.

A grinder of the kind defined above, in which a calculated inference as to the arrangement of the grinding table is drawn from measurements on a roller suspension, is known from each of U.S. Pat. No. 7,182,283 B1 and EP 2 221 129 A1. If the underlying assumptions are not satisfied, serious damage can occur or unwanted shutdowns can take place. This is the case when there are problems with the ground material, for example. US 2018/099288 A1 discloses a bearing for a grinder. U.S. Pat. No. 5,191,713 A deals with tilt measurements in general.

Industrial grinders of the kind defined above, in particular vertical mills which are used in cement grinding, for example, comprise a grinding table which is set in rotation by means of a drive. During operation, multiple grinding rollers distributed over the periphery press on the grinding table and grind the ground material transferred to the grinding table. The grinding table rotates during this about a first rotational axis and the grinding rollers each rotate about a second rotational axis in each case. If the dead weight of the grinding wheels should not be sufficient for the comminution of the ground material, force is imposed on the grinding wheels, usually hydraulically, so that the grinding table is uniformly loaded by all grinding rollers. The compressive and transverse forces naturally occurring during the grinding process are absorbed via the bearing arrangement of the grinding table. A bearing arrangement of this kind is usually designed as a slide bearing arrangement, wherein the bearing arrangement is frequently a constituent part of the gearing which sets the grinding table in rotation.

In case of uneven compressive forces of the individual grinding rollers caused by a technical fault in the hydraulics of the grinding rollers, for example, or in the system controls of a cement mill, for example, the bearing arrangement of the grinding table is exposed to a tilting moment in addition to the compressive forces. Since the bearing arrangement of the grinding table can only absorb compressive and transverse forces structurally speaking, the grinding table can tilt in such cases and the bearing arrangement of the grinding table, e.g. an axial slide bearing and/or the gearing of a vertical mill beneath the grinding table, can be damaged.

Based on the problems and disadvantages of the prior art, the problem addressed by the invention was that of detecting a grinding table tilt in good time and thereby preventing any damage to the grinder.

SUMMARY OF THE INVENTION

In order to solve the problem according to the invention, a grinder is proposed as set forth hereinafter. In addition, the invention proposes a method for the operation of a grinder in accordance with the method claims. The dependent claims in each case contain advantageous developments of the invention.

The grinder according to the invention is preferably a vertical mill, wherein the first rotational axis in this case preferably has a substantially vertical orientation. A grinder according to the invention has at least two grinding rollers, each of which is arranged so as to rotate about a second rotational axis in each case, in such a manner that ground material can be comminuted between the grinding table and the circumferential surfaces of the grinding wheels during operation. In this case, the grinding rollers have a substantially cylindrical or conical grinding surface shape, said grinding surfaces being engaged with the grinding table or the ground material in a rolling manner. The multiple grinding rollers each have their own second rotational axis, wherein the second rotational axis is not conceptually different for the individual grinding rollers, as these do not differ from one another fundamentally, except for their respective orientation and circumferential position. The second rotational axes in this case are each at a substantially obtuse angle to the first rotational axis, wherein a right angle, in particular, is also conceivable. The circumferential surfaces of the grinding rollers, which come into contact with the ground material in a comminuting manner, are particularly preferably conical in design, wherein the conical angle preferably relates to the angle between the first and the second rotational axis, in such a manner that a substantially linear support is created between the grinding table and the grinding roller. The terms "grinder" and "miil" are used substantially synonymously in the present case.

Terms such as "radial", "tangential" or "circumferential direction" each relate to the first rotational axis or, if specified accordingly, to a second rotational axis in each case.

The sensor arrangement according to the invention, which detects a change in inclination of the grinding table beyond a given threshold value, enables damage to slide bearings or other bearings of the grinding table and adjacent components in the case of grinders according to the invention, in particular vertical mills, which would have serious consequences, to be prevented. Accordingly, long production stoppages and costly repairs are avoided. The clear identification of a change in inclination of the grinding table according to the invention allows the tilting of the grinding table to be distinguished from any translatory movements which are usually unproblematic for the operation of the bearings of the grinding table. Determining that a given threshold value has been exceeded in relation to the change in inclination of the grinding table allows an alarm to be raised at an early stage during tilting, so that problems with the oil supply to the bearings, for example, can be accurately distinguished from the tilting of the grinding table as a consequence of uneven loading.

An advantageous development envisages that the grinder comprises a central processing unit and at least one human-machine interface, wherein the central processing unit is connected to the human-machine interface and the sensor arrangement and wherein the central processing unit is designed in such a manner that an alarm can be displayed by means of the human-machine interface, as soon as a change in inclination of the grinding table beyond the given threshold value is detected by the sensor arrangement. Depending on the operating situation of the grinder otherwise, the operating personnel can immediately decide by means of this alarm whether the grinder needs to be stopped and the cause of any tilting needs to be ascertained.

It is possible in principle for the grinding table of the grinder to be supported by means of roller bearings, wherein the bearing arrangement is preferably achieved by means of slide bearings, particularly preferably by means of tilting pad slide bearings.

A preferred development of the invention envisages that the sensor arrangement comprises sensors which are designed as eddy current sensors, tracers, optical sensors or capacitive sensors. It is desirable in this case for the sensor arrangement to comprise at least three path sensors. Particularly advantageously, these path sensors can measure a positional change or a distance change against a bearing tread surface of the grinding table, wherein the arrangement of these path sensors is preferably designed in the form of a triangle.

It is particularly desirable for the central processing unit with the sensor arrangement to determine from measurements taken by the sensor arrangement a tilting angle which indicates the angular deviation of the actual first rotational axis from the specified orientation of the first rotational axis.

It is particularly desirable for the central processing unit to be designed in such a manner that said central processing unit determines from measurements taken by the sensor arrangement the direction of tilt, so that the circumferential position of the lowest or highest point due to the tilt can be displayed on the display device. In this way, repairs to the grinder or the elimination of the cause of the tilt are accelerated and the availability of the grinder increased accordingly.

The method according to the invention for operating a grinder, in particular of the kind defined above, comprises the operation of the grinder, measurement of variables which allow a tilt of the grinding table from a specified position to be determined, comparison between a change in inclination of the grinding table and a given threshold value, output of an alarm by means of a human-machine interface to the effect that the change in inclination of the grinding table has reached, or exceeded, the given threshold value. The change in inclination of the grinding table relates in principle to a change in orientation of the first rotational axis of the grinding table in the present case.

An advantageous development of the method according to the invention envisages that a tilting angle is detected by means of the central processing unit, said angle indicating the angular deviations of the present first rotational axis from the specified orientation of the first rotational axis. Furthermore, displaying the tilting angle on a display device of the grinder or by means of the human-machine interface is particularly advantageous. This indication of the tilting angle allows the operating personnel of the grinder to initiate measures to stop incorrect tilting quickly and to resume operation of the grinder.

BRIEF DESCRIPTION OF THE DRAWING

A further acceleration of the maintenance work that may be necessary allows an advantageous development of the method, in which the direction of tilt is determined, so that the circumferential position of the lowest point or the highest point on account of the tilt can be displayed on the display device. The invention is described in greater detail below for clarification purposes with the help of a special exemplary embodiment. In the drawings.

DETAILED DESCRIPTION OF PREFERRED EMBODIMENTS

Figure 1:
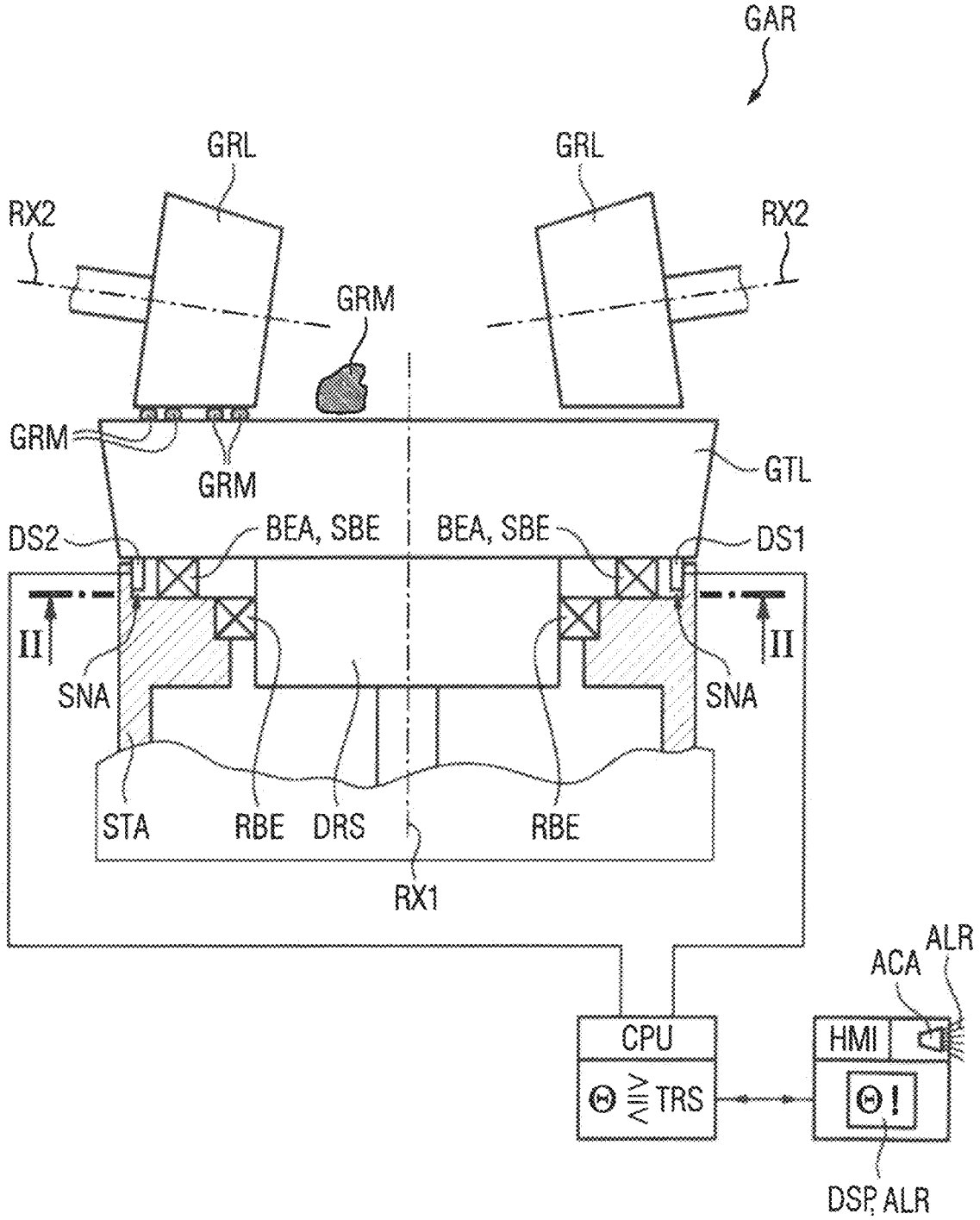
FIG. 1 shows a schematic longitudinal section through a grinder according to the invention.

FIG. 1 shows a schematic representation of a longitudinal section of a detail of a grinder GAR according to the invention. The grinder GAR comprises a grinding table GTL which is rotatable about a first rotational axis RX1 and at least two grinding rollers GRL which are each arranged so as to rotate about a second rotational axis RX2 in each case. The ground material GRM is comminuted between the grinding table GTL and the grinding rollers GRL during operation. The individual second rotational axes RX2 of the individual grinding rollers GRL each form an obtuse angle with the first rotational axis RX1 of the grinding plate GTL, which angle may also be right-angled. In the present case, the grinding rollers GRL are designed with conical grinding surfaces. Accordingly, the second rotational axes RX2 are oriented obliquely to the first rotational axis RX1.

The grinding table GTL is equipped axially by means of bearings BEA which are designed as slide bearings SBE and in this case as tilting pad bearings TPB. The grinding table GTL is set in rotation about the vertical first rotational axis RX1 by means of a drive which is not shown by means of a drive shaft DRS. The drive shaft DRS in this case is mounted on a stator STA by means of radial bearings RBE, in such a manner that the first rotational axis RX1 is vertically oriented.

Figure 2:
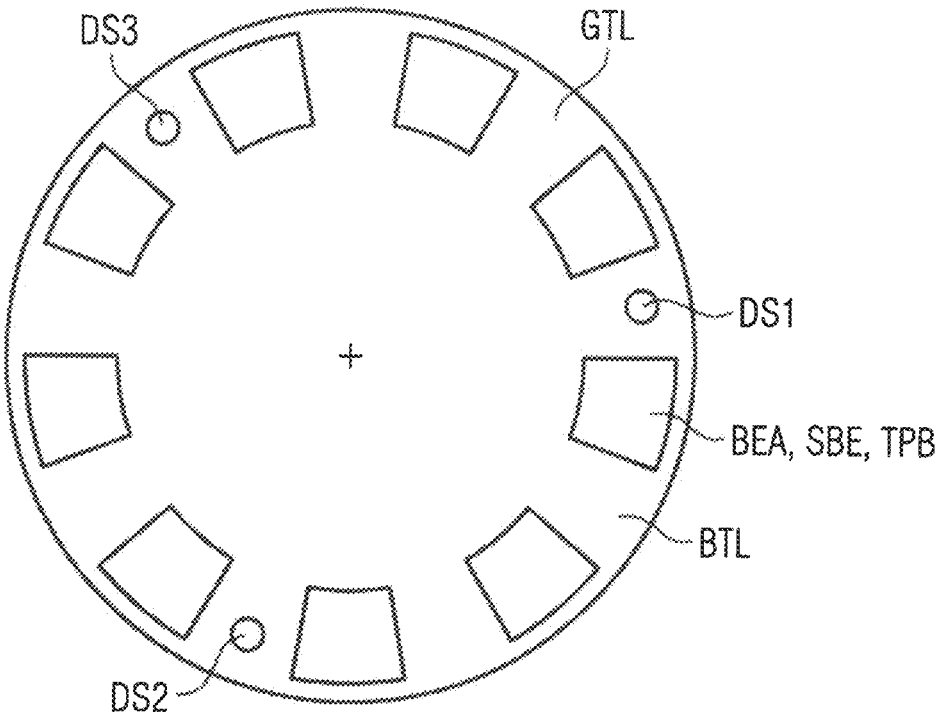
FIG. 2 shows a section according to II-II in FIG. 1.
Figure 3:
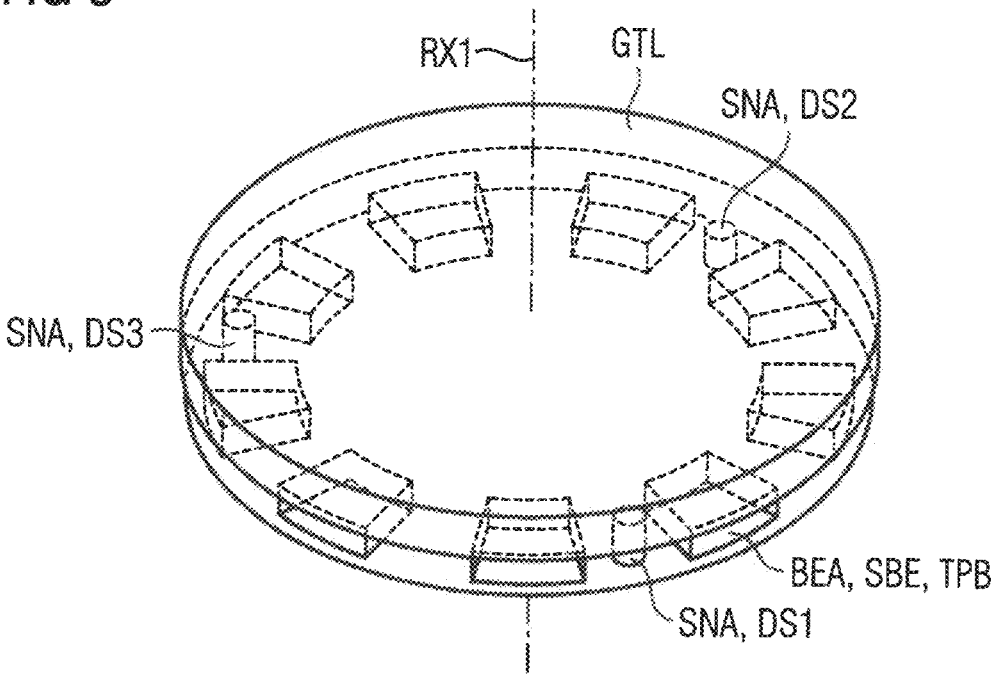
FIG. 3 shows a perspective schematic representation of the grinding table, the sensor arrangement and the bearing arrangement of the grinding table.

Located in the region of the axially effective bearing BEA are sensors DS1, DS2, DS3 of a sensor arrangement SNA which determines a tilt of the grinding table GTL on a central processing unit CPU connected to the sensor arrangement SNA. As is also shown schematically in FIGS. 2, 3 and 4, sensors DS1, DS2, DS3 are preferably located close to the axially effective bearing arrangement BEA, so that the sensors DS1-DS3 can measure against the bearing surface of the grinding table GTL. The sensors are designed as path sensors in the example, so that a change in distance between the stator STA and the grinding table GTL is detected by the sensors. Insofar as the sensors DS1-DS3 measure different distances, it can be assumed that the first rotational axis RX1 deviates from the original specified position in the manner of a change in inclination of the grinding table GTL.

Figure 4:
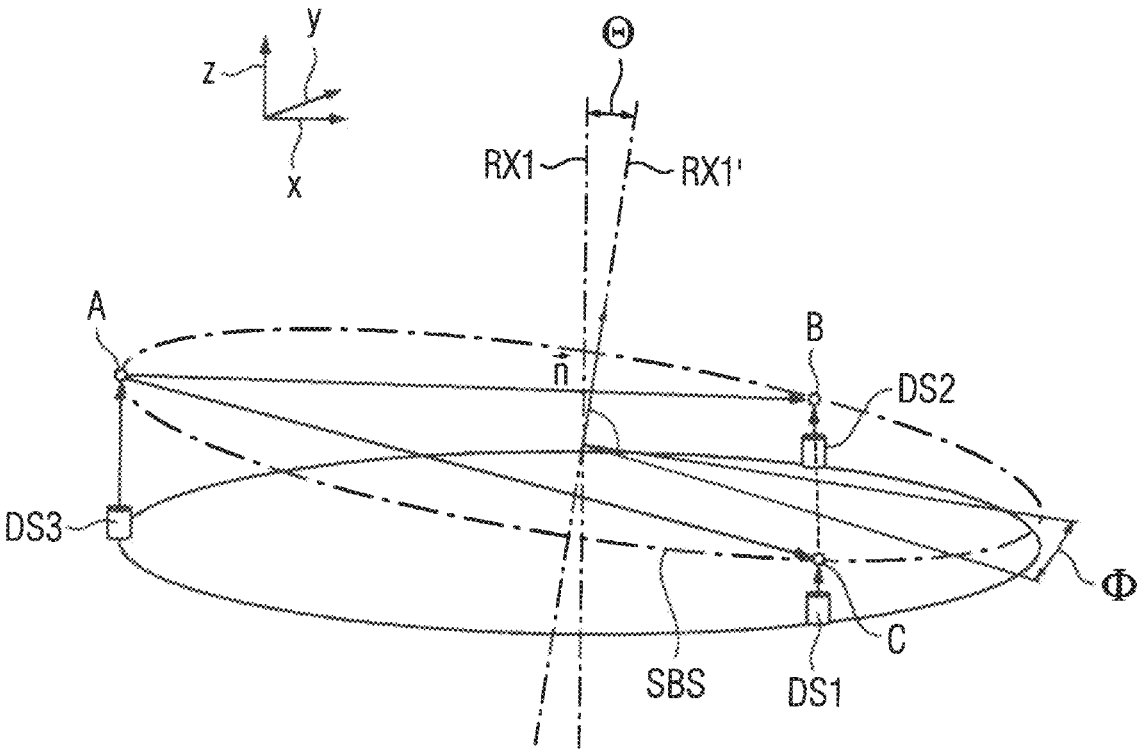
FIG. 4 shows a schematic representation of the geometric relationships between the grinding table, the tilt and the sensor arrangement.

FIG. 4 shows the method for determining the tilting angle of the grinding table $\Theta$ and the azimuth angle $\phi$ of the tilt by means of the central processing unit CPU. The central processing unit CPU initially determines the coordinates of the points detected by the sensor arrangement SNA on the circumferential slide bearing tread surface SBS of the grinding table GTL. Based on the example of three sensors DS1, DS2, DS3, the following results from FIG. 4:

$$\vec{A}(t = \begin{pmatrix} x_{0,A} \\ y_{0,A} \\ s_1(t) \end{pmatrix}; \vec{B}(t = \begin{pmatrix} x_{0,B} \\ y_{0,B} \\ s_2(t) \end{pmatrix}; \vec{C}(t = \begin{pmatrix} x_{0,C} \\ y_{0,C} \\ s_3(t \end{pmatrix}$$

The coordinates $x_{0,A,B,C}$, $Y_{0,A,B,C}$, in this case denote the structurally fixed position of the sensor in a fixed Cartesian coordinate system of arbitrary origin, the z-axis of which coincides with the first rotational axis RX1 or the grinding table GTL in the non-tilted state. The coordinates si(t) correspond to the measurements of the path sensors DS1, DS2, DS3. The tilting of the grinding table GTL is calculated by means of the normal vector of the plane, which corresponds to the rotating tread surface of the slide bearing. The normal vector of this plane is determined through the formation of the cross product between the connection vectors AB and A:

$$\vec{n}(t = \frac{\vec{AB}(t \times \vec{AC}(t}{\left\|\vec{AB}(t \times \vec{AC}(t\right\|}$$

The tilting angle of the grinding plate over time Θ(t results over the scalar product of the normal vector $\vec{n}(t)$:

$$\Theta(t) = \arccos\left(\frac{\vec{n}(t) \cdot \vec{e}_z}{\left\|\vec{n}(t)\right\| \cdot \left\|\vec{e}_z\right\|}\right) = \arccos\left(\vec{n}(t) \cdot \vec{e}_z\right)$$

where $\vec{e}_z$ denotes the unit vector in the z-coordinate direction. The direction in which the grinding table GTL tilts can be described via the azimuth angle ϕ, which describes the angle to the x-axis in the XY plane. This can be determined via $$\phi(t) = \begin{cases} \arctan\left(\frac{y}{x}\right) & y > 0 \\ \arctan\left(\frac{y}{x}\right) & y < 0 \\ 0 & y = 0, x > 0 \\ 90° & y = 0, x < 0 \end{cases}$$

where the angle ϕ can adopt values of [0, 2π].

An orbit plot can be used for the graphic visualization of the two characteristic values. For this purpose, the normal vector of the plane projects onto the XY plane. The tilt of the grinding table can thereby be visualized for diagnostic purposes.

Figure 5:
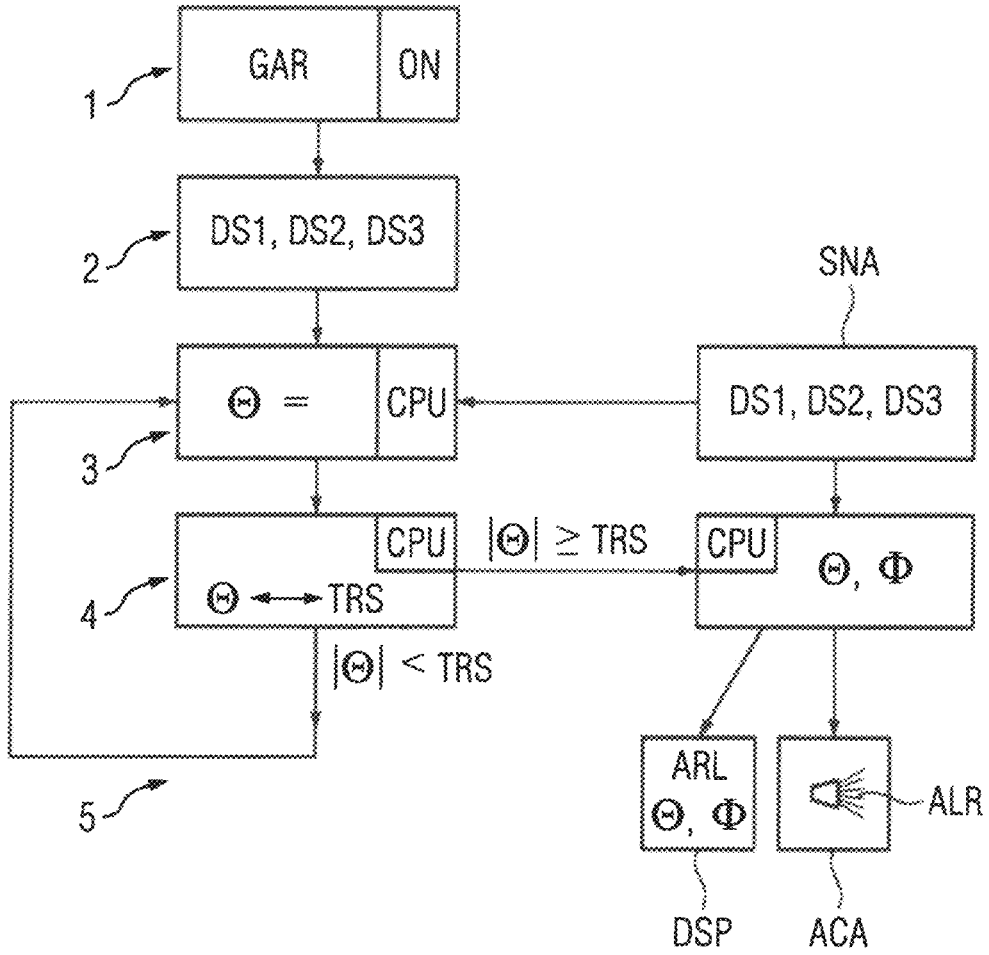
FIG. 5 shows a schematic flow chart of the method for operating a grinder according to the invention.

FIG. 5 shows a schematic flow chart of the method for operating a grinder according to the invention. Initially, the grinder GAR is put into service (1) and the measurement of variables (2) begins subsequently or simultaneously, said variables allowing a tilt of the grinding plate GTL to be determined from a specified position. Based on these measurements (2)), a comparison (3)) is made between a change in inclination of the grinding table GTL and a given threshold value TRS. Particularty preferably, the central processing unit CPU determines a tilting angle θ for this purpose from the measurements of the sensor arrangement SNA, the sensors of which DS1, DS2 and DS3 each deliver distances between the stator STA and the grinding table GTL. If the change in inclination θ of the grinding plate GTL exceeds the given threshold value TRS, the output of an alarm ALR (4)) by means of a human-machine interface HMI takes place, to the effect that the change in inclination θ of the grinding plate GTL has reached, or exceeded, the given threshold value TRS. The alarm can be output on an optical display device DSP or on an acoustic display device ACA as an alarm ALR. Insofar as the grinder is not switched off, the cycle of comparison 3 based on the measurements of the sensor arrangement SNA and the evaluation of the central processing unit CPU is repeated and the output of an alarm ALR is repeated where necessary. It is particularly preferable for the tilting angle θ to be displayed on the display device DSP of the grinder GAR. An advantageous development also involves determining the direction of the tilt Φ, so that the circumferential position of the lowest point or the highest position due to the tilt can be displayed on the display device DSP.

What is claimed is:

1. A grinder, comprising:

a grinding table rotatable about a first rotational axis;

at least two grinding rollers, each of the at least two grinding rollers being arranged for rotation about a second rotational axis such that ground material is able of being comminuted between the grinding table and the grinding rollers during operation; and a sensor arrangement configured to detect a change in inclination of the grinding table beyond a given threshold value.

2. The grinder of claim 1, further comprising a central processing unit and a human-machine interface, said central processing unit connected to the human-machine interface and the sensor arrangement and designed to display an alarm by the human-machine interface, as soon as the sensor arrangement detects that the change in inclination of the grinding table exceeds the given threshold value.

3. The grinder of claim 1, further comprising bearings for support of the grinding table.

4. The grinder of claim 3, wherein the bearings are designed as slide bearings.

5. The grinder of claim 1, wherein the sensor arrangement comprises sensors designed as eddy current sensors, tracers, optical sensors or capacitive sensors.

6. The grinder of claim 1, wherein the sensor arrangement comprises at least three path sensors.

7. The grinder of claim 6, wherein the at least three path sensors measure against a bearing tread surface of the grinder table.

8. The grinder of claim 6, wherein the at least three path sensors are arranged so as to describe a triangle.

9. The grinder of claim 3, wherein the bearings are designed as tilting pad bearings.

10. The grinder of claim 2, wherein the central processing unit is designed to determine in response to measurements of the sensor arrangement a tilting angle which indicates an angular deviation of the first rotational axis from a specified orientation of the first rotational axis.

11. The grinder of claim 2, wherein the central processing unit is designed to determine in response to measurements of the sensor arrangement a direction of tilt, and further comprising a display device configured to display a lowest or highest point of a circumferential position due to the tilt.

12. A method for operating a grinder, said method comprising:

measuring variables as the grinder is in operation to determine a tilt of a grinding table of the grinder from a specified position;

comparing a change in inclination of the grinding table with a given threshold value; and outputting an alarm via a human-machine interface, when the change in inclination of the grinding table has reached, or exceeded, the given threshold value.

13. The method of claim 12, further comprising:

determining a tilting angle of the grinding table as the grinding table rotates about a rotational axis to indicate an angular deviation of the rotational axis from a specified orientation; and displaying the tilting angle on a display device of the grinder.

14. The method of claim 12, further comprising:;

determining a direction of tilt of the grinding table; and displaying a circumferential position of a lowest point due to the tilt on a display device of the grinder.

* * * * *